US005790025A

United States Patent [19]

Amer et al.

[11] Patent Number: 5,790,025

[45] Date of Patent: Aug. 4, 1998

[54] TAMPER DETECTION USING BULK MULTIPLE SCATTERING

[75] Inventors: Nabil Mahmoud Amer, Berkeley, Calif.; David Peter DiVincenzo, Chappaqua, N.Y.; Neil Gershenfeld, Somerville, Mass.

[73] Assignee: International Business Machines Corporation, Armonk, N.Y.

[21] Appl. No.: 695,199

[22] Filed: Aug. 1, 1996

[51] Int. Cl.[6] ..... G08B 13/14

[52] U.S. Cl. ..... 340/571; 340/557; 340/553; 340/555; 340/568; 342/28; 250/221

[58] Field of Search ..... 340/557, 552, 340/553, 554, 555, 556, 571, 572, 562, 541; 367/93; 342/27, 28; 250/221, 216, 215, 372

[56] References Cited

U.S. PATENT DOCUMENTS

| | | | |
|---|---|---|---|
| 3,683,352 | 8/1972 | West et al. | 340/557 |
| 4,367,458 | 1/1983 | Hackett | 340/539 |
| 4,367,460 | 1/1983 | Hodara | 340/550 |
| 4,710,627 | 12/1987 | Baltes et al. | 250/339.11 |
| 4,760,381 | 7/1988 | Haag | 340/556 |
| 4,935,723 | 6/1990 | Vallance | 340/550 |
| 4,952,939 | 8/1990 | Seed | 342/27 |
| 5,365,218 | 11/1994 | Otto | 340/557 |

*Primary Examiner*—Jeffery A. Hofsass
*Assistant Examiner*—Benjamin C. Lee
*Attorney, Agent, or Firm*—Stephen S. Strunck

[57] ABSTRACT

The multiple scattering of coherent radiation in an inhomogeneous medium is used to detect attempted intrusions into a protected area or into a tamper-proof package for such purposes as preventing the unauthorized detection and copying of electronic information used for authentication and coding in electronic commerce, communications, command, and control systems. A key advantage is that any intrusion into the sensed volume will produce a detected change in the measured intensity which will be equal to the full amplitude range if the intrusion is into a cylinder with radius comparable to the wavelength of the sensing radiation. The response of the medium can also be used to provide a unique identity key.

14 Claims, 2 Drawing Sheets

TAMPER DETECTION USING BULK MULTIPLE SCATTERING

BACKGROUND OF THE INVENTION

Electronic commerce, communications, command and control systems rely on the availability of a reliable means to authenticate and protect transactions. In such systems, there is usually secure information such as a serial number, cryptographic key, or decoding algorithm that must be provided to the user for access control. This information can have great value and if it can be detected and copied then unauthorized users can obtain fraudulent access. Therefore, the packaging of this authentication and decoding information must permit easy access for allowed operations, but prevent any other kind of attempted physical access. For this reason, there is a recurring need for means to render electronic circuitry tamper-proof.

Methods exist for protecting systems by continuous measurements on its surroundings such that if an intrusion is detected, the system responds by rapidly erasing some stored information. Techniques such as measuring the capacitance between an inner and an outer electrode is in effect measuring over many parallel channels. A change in any single channel, such as might be caused by an intruder drilling a hole in an electrode, leads to a measured change that is proportional to the area modified divided by the total area (and hence can be made small by a determined intruder). The present system leads to a much greater measured disturbance per amount of material changed, and so has superior sensitivity to intrusion. Another technique in the prior art in electronics involves wrapping the part to be protected in a long strand of wire which encircles the part to be protected many times. The system monitors the resistance of the wire, which would be changed by a naive intruder attempting to burrow into the package. This system has a weakness which the present invention does not have. In some realizations of this technique, the package is mass-produced and identical from part to part. An intruder can understand the wiring geometry by studying one part, then invading another by drilling so as to avoid breaking the wire, or by simultaneously breaking the wire and shunting the break so that no change in the total resistance of the wire occurs. One could envision a system, which is not believed to be in use presently, where the wire wrapping is unique from one part to another. Such a system could still be defeated by a determined intruder who detects and avoids the sensing wires and would be much more difficult to manufacture than the present invention, which merely requires the stirring of particles or air bubbles into a clear packaging epoxy.

To be commercially viable, a secure packaging system must be inexpensive, so that it can be widely used, it must be sensitive so that it detects all attempted intrusions, and it must be immune to routine environmental perturbations to prevent false triggers. Existing means do not simultaneously satisfy all of these conflicting requirements. This invention teaches a new approach, based on the multiple scattering of coherent radiation in an inhomogeneous material, that meets these needs. A key advantage is that any intrusion into the sensed volume will produce a detected change in the measured intensity which will be equal to the full amplitude range if the intrusion is into a cylinder with radius comparable to the wavelength of the sensing radiation. The response of the medium can also be used to provide a unique identity key.

SUMMARY OF THE INVENTION

The invention is a system which uses the sensitivity of multiply-scattered coherent radiation to disturbance of a scattering medium to detect attempted intrusion. The system consists of a source of coherent radiation (visible light, infrared light, sound, ultrasound, microwave radiation, or other forms of coherent radiation). This source may either be attached directly to or in intimate contact with the object to be protected which may be an electronic circuit; electronic, magnetic, optical, or other memory device; or a larger structure such as a building. Alternatively, the source may be a public, trusted beacon of such radiation from outside the system. The radiation is emitted into the space surrounding the object to be protected. The space consists of a transparent medium, which might be vacuum, air, clear plastic, glass, or other transparent medium which contains a multitude of scatterers or reflectors. The scatterers or reflectors may be voids or bubbles or solid objects such as dielectric or metallic beads, small mirrors or, for a larger system, stationary objects such as trees or automobiles that do not absorb the radiation. These scatterers are placed randomly, may be moved from time to time (but not during the operation of the intrusion detection system), and are separated by a distance which is comparable to the wavelength of the coherent radiation. After many scatterings, the intensity of the radiation is detected by sensors located on the protected object. There may be one sensor or more than one sensor. Multiple sensors can be used to distinguish between changes in the source intensity and an intrusion event. If the sensors detect a change in the intensity of radiation which the system cannot account for, it will assume that an intrusion has been initiated and, using known methods will alert the system to be protected of the danger of intrusion or issue a command causing the erasure on destruction of sensitive or proprietary information residing in the protected object.

The leads bringing electrical signals into and out of a protected circuit represent a potentially vulnerable part of the system. In an alternative embodiment, these are unjacketed fiber optic cables so that the coherent radiation can also sense disturbances of the fiber. A photovoltaic device can be used to convert the light in the fiber into electrical energy to power the circuit, as well as communicate with it.

The system may have a number of features which adjust the sensitivity of the intrusion system. For example, a buffer region may be established which would guard the region containing the scatterers from inadvertent perturbation, elastic deformation, stray light, or shocks. Absorbers may be placed throughout the volume of the system. These selectively reduce the sensitivity by reducing the number of paths which pass from the source to the detector(s). Finally, pathways may be provided for authorized traffic or energy to pass from outside to the protected object.

BRIEF DESCRIPTION OF THE DRAWINGS

The invention will be more fully understood and further advantages will become apparent when reference is made to the following detailed description of the preferred embodiments of the invention and the accompanying drawings in which.

DETAILED DESCRIPTION OF THE INVENTION

Figure 1:
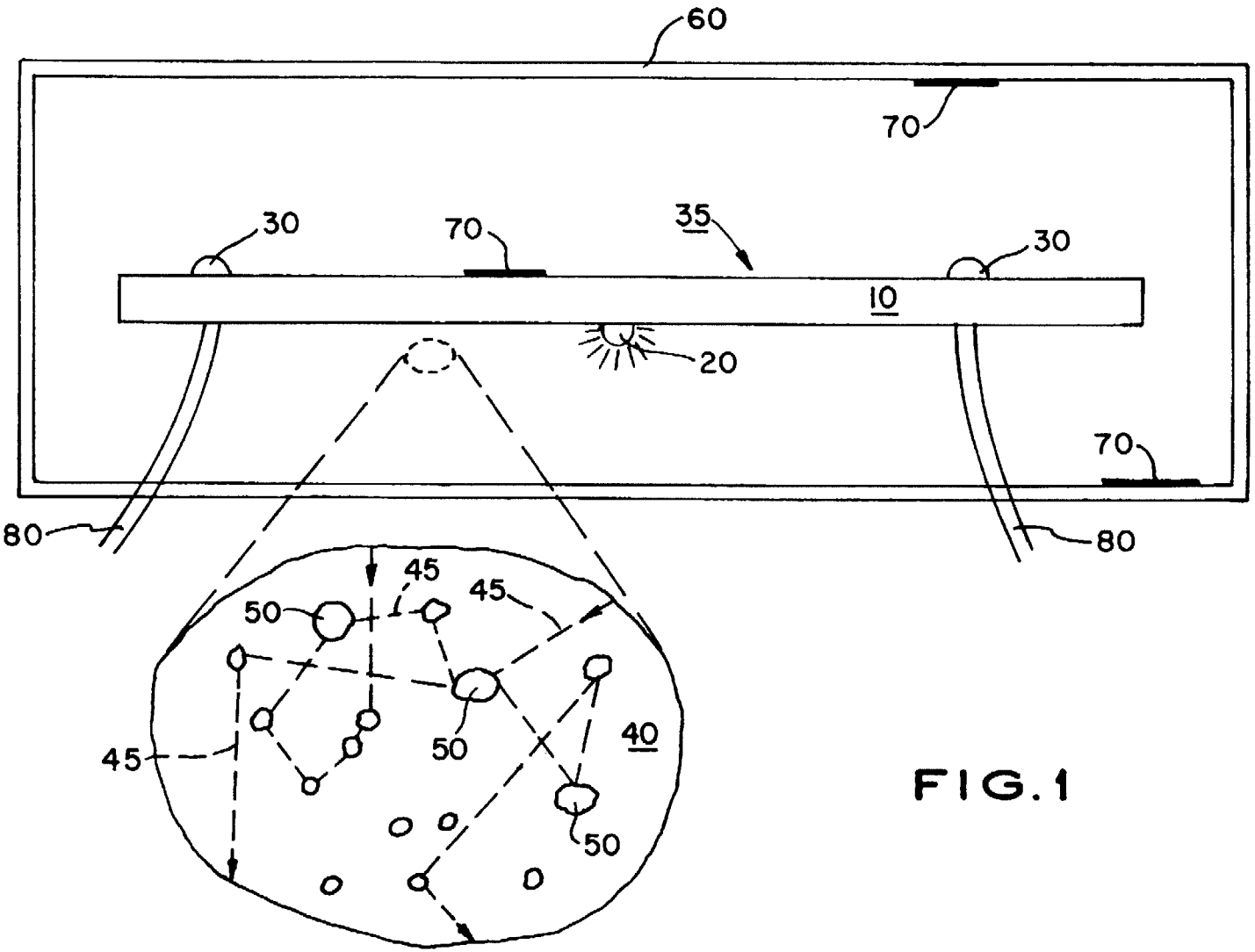
FIG. 1 is a block diagram of an intrusion and tamper resistant device according to the present invention.

The intensity of radiation arriving at any point, e.g., one of the points 30 in FIG. 1, from a single emitting point 20 is a very complex function of the details of the randomness in the medium 35. Consider media which are lossless (non absorbing) but which consist of many scatterers or reflectors 50 distributed randomly throughout the medium, separated by a characteristic average distance l. By definition, coherent radiation has a definite frequency, here $\omega$, and a corresponding wavelength, here $\lambda$. The only paths open for rays of radiation to pass from 20 to 30 involve a multitude of successive reflections from scatterers 50. There will always be a very large number of alternative paths for going from 20 to 30; a portion of a few selected paths are indicated as 45 in the diagram.

If there are $N_p$ distinct paths for going from 20 to 30, the total amplitude of the radiation arriving at 30 can be calculated by summing all the distinct contributions:

$$A=\sum_{k=1}^{N_p}(|a_k|/\sqrt{N_p})\,e^{i\phi_k} \tag{1}$$

The phase associated with each path $\phi_k$ is given by $2\pi\chi_k/\lambda$ where $x_k$ is the length of the $k^{th}$ path. This phase will be much greater than $2\pi$ in all cases of interest, so that $\phi_k$ can be taken as a random phase between 0 and $2\pi$. The formula above assumes that each path gets about $1/\sqrt{N_p}$ of the total wave amplitude, so that the fluctuations in the individual amplitudes $a_k$ are small. This equation is visualized as a random walk in the complex plane, each term of the sum representing a step in the walk with random direction (corresponding to the random phase). Since it is well known that a random walk gets a distance $\sqrt{N}$ from the origin after N steps, the typical amplitude $|A|$ will be of order $\sqrt{N_p}(\langle|a_k|\rangle/\sqrt{N_p})=\langle|a_k|\rangle$, independent of the number of paths. Another feature of a random walk is that the variation in the distance from the origin is as large as the mean; this implies that the variance of $|A|$ is the same as its average, so that the fluctuations of the amplitude are 100% (between two samples with different random positions of the reflectors, for instance). This 100% variance will be realized, for example, simply by moving the detector position by the distance of a wavelength or so. This will change the values of all the phases in the equation, resulting in a different random walk in the complex plane. It is this variation which is known as "speckle" in the context of the scattering of laser light from a surface.

If the scattering volume is intruded upon and the random reflectors disturbed, the detected intensity will change. A model in which the scattering paths 45 execute random walks in space from the source 20 to the detector 30 can be used to predict the sensitivity to intrusion. (This is a different random walk than the "random walk in the complex plane" introduced in the preceding paragraph.) If the straight line distance between the source 20 and the detector 30 is about L, then the length of a typical scattering path will be about $x_p=L^2/l$. The number of scatterers which any one path will visit is about $x_p/l=(L/l)^2$. This is much greater than L/l, which is the number of scatterers which a straight line path from 20 to 30 would visit. If the total scattering volume is also of size $L^3$, then the total number of scatterers is about $(L/l)^3$. From this comes the very important conclusion that the fraction of scatterers that are visited by any given path is about l/L.

Suppose that one of the scatterers anywhere in the scattering volume is disturbed in some way during an intrusion event. The fractional amount by which the amplitude of the transmission is changed is given by redoing the sum in Eq. (1), just summing over those paths ($N_p l/L$ of them) which have been changed by the disturbance:

$$\Delta A/\langle|A|\rangle=\frac{1}{\langle|a|\rangle}\sum_{k=1}^{N_p l/L}(|a'_k|/\sqrt{N_p})\,e_k^{i\phi}=\sqrt{\frac{l}{L}} \tag{2}$$

The last equation is again obtained by applying the "random walk in the complex plane" analysis. This is a very high sensitivity to such a change, given that any average property of the material not related to phase coherence (for example, the total capacitance of the material) would change by a fractional amount of about $(l/L)^3$. The same analysis shows that if n scatterers are disturbed, the fractional change of the transmitted amplitude is given by $\Delta A/\langle|A|\rangle=\sqrt{nl/L}$. Therefore, an attempt at intrusion by "tunneling" through a distance L of material, which would disturb about n=L/l scatterers, would produce a disturbance of the amplitude on the order of 100%. Disturbances much, much less than this would be easily detectable. The general theory also gives a prediction for how the sensitivity is modified if the coherence of the radiation is not perfect (this is important if partially coherent light is produced by band-pass filtering an incoherent source). If the radiation is not perfectly coherent, then it will not be perfectly monochromatic, so that the wavelength $\lambda$ will be fluctuating in time. This will cause the received radiation to vary as a function of time, and the actual measured signal will be a time average of the squared-amplitude of the radiation. The sensitivity of the radiation to position will not be washed out at all by this effect if the fluctuations of the wavelength $\Delta\lambda$ are small enough that the amplitudes and phases do not vary significantly with time. When the wavelength varies by $\Delta\lambda$, the phases appearing in Eq. (1) vary by $x_p\Delta\lambda/\lambda^2$. Requiring this phase fluctuation to be much less than one so that the total amplitude is not significantly changed, and using the random-walk expression for the path length, $x_p$, gives a bound on the magnitude of the wavelength fluctuation which will cause no discernible effect on the speckle: $\Delta\lambda<B_c\cong(l\lambda/L^2)\lambda$. If this inequality is satisfied, the relative variation of the intensity of the speckle pattern when the volume is disturbed remains on the order of 100%. If the inequality is not satisfied, then the total intensity can be thought of as an incoherent sum of $\Delta\lambda/B_c$ different random patterns. In this case, the relative change of intensity will be on the order of $\sqrt{\Delta\lambda/B_c}$. The system must be designed such that this variation of intensity is in the range that it can be easily detected at positions 30.

Another constraint on the radiation field comes from the requirement that the light amplitude be small at the outer surface of the encapsulant layer so that it does not respond to surface changes. In steady-state, the average light intensity distribution n(r) depends only on the boundary conditions; in the approximation of a point source and homogeneously distributed scatterers, it will then fall off as:

$$n(r)=1/r \tag{3}$$

In the complex geometry of Fig.1, the actual density will be determined by the solution of Laplace's equation for this structure. The light amplitude field may be diminished at long distance by selective insertion of light absorbers 70 in various places around the package.

Varying the frequency of the radiation, or the position of source or sources 20 or receiver or receivers 30 generates a new sampling of the paths and therefore a full magnitude change in the signal. This change is completely reproducible, however, and can be used as a read-only key that is extremely difficult to duplicate. Such a key might be formed by indexing (moving) receiver 30 at several locations along the surface of object 10 and recording the intensities at each location. This list of intensities serves as the read-only key which uniquely identifies object 10 and its environs i.e., system 5. Optionally, the source can be tunable, or the source or receivers can be arrays, in order to measure the unique "fingerprint" (read-only key) of the medium.

In the preferred optical embodiment, there is a single transmitting light source 20. This could be a laser diode, or a broad-band diode with a narrow-band filter. This is less efficient, but in a typical embodiment the sensitivity of this device is not limited by the photon shot noise. If it proves desirable to have a low-intensity, very high coherence light source, an electroluminescent material in which atomic lines are excited by impact ionization may be used.

If there are two receivers 30 producing intensity signals $R_1$ and $R_2$, these may be combined as:

$$(R_1-R_2)/R_2. \quad (4)$$

This will not change if the transmitted amplitude fluctuates, but will change if there is an intrusion event. The receivers are mounted so that there is no direct optical path between them and the source to insure that the detected signal is due solely to multiple scattering and hence is most sensitive. The detected signal could be processed on-board object 10, such as by a dedicated microprocessor, and used to sound an alarm, cause object 10 to alter its state or take other chosen anti intrusion actions or defenses.

The source, receivers, and the other circuitry being protected are encapsulated in a rigid optically clear epoxy (such as is used for potting LEDs). This is connected to the outside by fine wires 80, which may be replaced by an unjacketed fiber optic cable that brings in power to a device 10 as well as serving as the conduit for logic signals. The advantage of the unjacketed fiber optic cable is that disturbance of the cable by an intruder will be detected by the radiation from source 20 which crosses the fiber transversely.

In the preferred embodiment, the scatterers are bubbles in the epoxy. The bubble fraction is controlled by the amount of air or inert gas stirred into the epoxy during mixing, and the bubble size is controlled by the epoxy viscosity, varied by a suitable diluent. To match commonly available efficient laser diodes, a typical length scale for the bubble size and spacing should be 1 μ.

Figure 2:
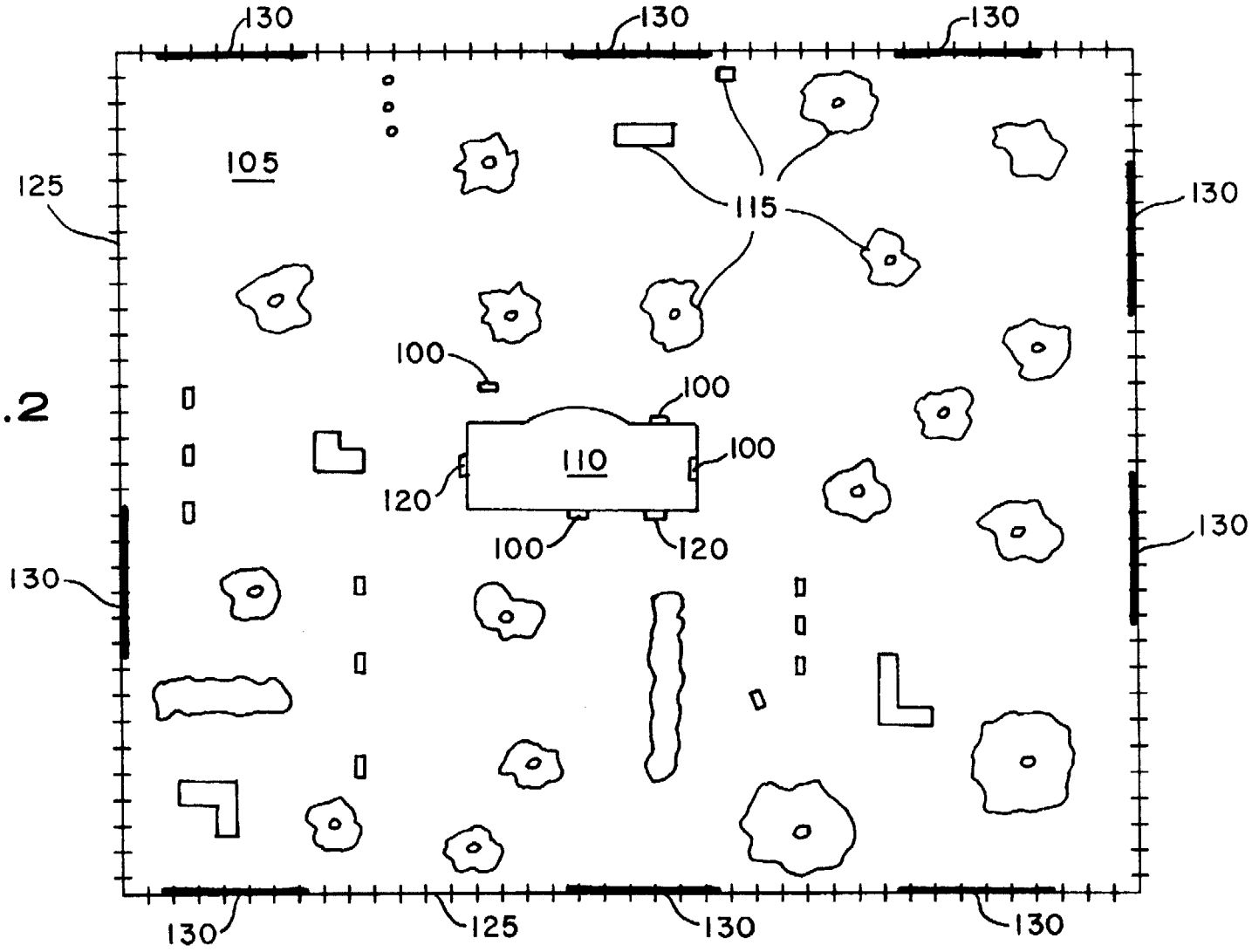
FIG. 2 is a schematic of the application of the invention to the protection of a large area.

FIG. 2 illustrates the preferred embodiment for protection of large-scale objects, e.g. the detection of intrusion of a secure site 105 surrounding a building or other sensitive installation 110. In this embodiment, the overall system implementation is very similar to that previously described. The source of coherent radiation may be a planar micropatch antenna 100, which can be no larger than a few centimeters in scale, and which can emit omnidirectional coherent radar-band radiation at a frequency from about 5 GHz to about 20 GHz, e.g., 10 GHz (wavelength $\lambda \cong 1$ cm). It would be possible to use just one source of this radiation, or 2 or 3 or several sources which are phase-locked to one another. These antennas may be mounted inside the location 110, affixed to its surface, or mounted on separate pedestals or other objects located near location 110. The height of the antennas may be within a short distance (20 feet) of ground level; or a simple modification of this embodiment would permit the antenna or antennas to be mounted at some height (on a transmitting tower, for example), above the site. Provision for a local or uninterruptible source of electric power to antennas 100 would be desirable.

Site 105 should be so designed, or landscape should be so constructed, that there exist a multiplicity of stationary objects 115 which serve as scatterers of the 10 GHz radiation. These could include trees and shrubs and other plantings, sculptures, pylons, outbuildings, or road obstructions. The height of these objects should be comparable to, or somewhat in excess of, that of the persons or vehicles whose intrusion it is desired to detect. The width of objects 115 can be anything greater than the wavelength (1 cm).

After scattering off the multiplicity of objects 115 (and possibly off an intruder), the radiation will be detected by two or more receivers 120. These receivers may be of very similar design to the patch antennas 100. As in the earlier embodiment, the signals from two receivers may be combined in a difference mode, in order that fluctuations in the transmission amplitude may be cancelled out.

The perimeter of the site will be delimited by a wall or fence 125. This wall or fence should be affixed with other objects 130, or should be themselves so composed, that most of the 10 GHz radiation is prevented from being transmitted off the site. This may be accomplished either by reflection or absorption. Thus, the objects 130 may be sheets of transparent or opaque electrical conductors, or other sorts of radar-band absorbers. This requirement will prevent legitimate persons or vehicles moving outside the site from being detected as intruders by the detection system.

The data obtained from the receivers 120, after the processing described above, will be analyzed to detect the presence of intrusion. In this analysis, variations of the difference signal of Eq. (4) as a function of time will be detected. the system will discriminate between time variation due to intrusion and time variation due to other incidental motion of flexible scattering objects such as trees. This could be accomplished by distinguishing the frequency of the time variation, which may be determined by a computation of the Fourier transform of the difference signal. Signals in the 1 Hz band would be interpreted as natural motion of trees due to wind, etc., while a signal in the 0.001–0.1 Hz band would be construed as an intrusion. Other standard signal processing and pattern recognition techniques may also be used. During times of authorized motion of persons or vehicles across site 105, the protection means of the invention would be interrupted and a conventional intrusion detection protocol or system such as inspection of video camera pictures of the site, and/or human patrol of the site or its perimeter, would be used.

Having thus described our invention, what we claim as new and desire to secure by Letters Patent is a follows:

1. A system for protecting an object comprising:

A. means for emitting coherent radiation;

B. means for detecting said coherent radiation;

wherein said object, emitting means and detecting means are encapsulated and further including means for scattering said coherent radiation.

2. The system of claim 1 in which the source of coherent radiation is a laser.

3. The system of claim 1 in which the source of coherent radiation is an electroluminescent material.

4. The system of claim 1 in which the source of coherent radiation is one selected from the group comprising microwave, radar, and radio sources.

5. The system of claim 1 in which the source of coherent radiation is tunable to measure the unique response of the medium.

6. The system of claim 1 in which the uniqueness of the system is provided by an array of receivers.

7. The system of claim 1 in which the uniqueness of the system is provided by an indexable receiver.

8. The system of claim 1 wherein said means for scattering include voids.

9. The system of claim 1 wherein said means for scattering include solid objects.

10. The system of claim 1 in which the object to be protected is a building or place of business.

11. The system of claim 1 in which the object to be protected is an electronic device.

12. The system of claim 11 in which power or signals to and from said electronic device are carried by unclad optical fibers which are embedded in said encapsulant.

13. The system of claim 1 in which the source of coherent radiation is a source of incoherent radiation which is passed through a narrow-band filter.

14. The system of claim 13 wherein said source of incoherent radiation is a diode.

* * * * *